US005582125A

United States Patent [19]

Matsumoto

[11] Patent Number: 5,582,125

[45] Date of Patent: Dec. 10, 1996

[54] SMALL JET PROPELLED BOAT

[75] Inventor: Chihiro Matsumoto, Hamamatsu, Japan

[73] Assignee: Sanshin Kogyo Kabushiki Kaisha, Hamamatsu, Japan

[21] Appl. No.: 143,344

[22] Filed: Oct. 25, 1993

[30] Foreign Application Priority Data

Oct. 24, 1992 [JP] Japan ..... 4-309246

[51] Int. Cl.[6] ..... B63B 35/00

[52] U.S. Cl. ..... 114/270; 440/40; 440/87

[58] Field of Search ..... 440/38–42, 49, 440/87, 113; 114/144 R, 151, 270

[56] References Cited

U.S. PATENT DOCUMENTS 4,270,307 6/1981 Arigaya ..... 440/49

4,587,918 5/1986 Burg ..... 440/38

FOREIGN PATENT DOCUMENTS 431193 2/1992 Japan .

*Primary Examiner*—Jesus D. Sotelo

*Attorney, Agent, or Firm*—Knobbe, Martens, Olson & Bear

[57] ABSTRACT

A jet propelled watercraft having a pair of jet propulsion units and a pair of powering internal combustion engines with a handlebar assembly for effecting steering of the watercraft. First and second throttle controls are carried by the handlebar assembly for controlling the speed of the engine so as to permit the operator to accelerate one engine upon turning, without taking his hands from the steering control to effect a sharper turn.

10 Claims, 3 Drawing Sheets

SMALL JET PROPELLED BOAT

BACKGROUND OF THE INVENTION

This invention relates to a small jet propelled boat, and more particularly, to an improved control and driving arrangement therefore.

There are a wide variety of small boats that are propelled by jet propulsion units so as to take advantage of the numerous favorable features of jet propulsion units. In many instances, it is desirable to provide a pair of separately driven jet propulsion units for such watercraft as they can improve the control and performance of such watercraft.

For example, a jet propelled watercraft is normally steered by means of a pivotally supported steering nozzle disposed in registry with the discharge nozzle of the jet pump. By pivoting these steering nozzles about a vertically extending axis it is possible to steer the watercraft.

If a pair of jet propulsion units are employed, then the steering nozzles are normally operated simultaneously by a common steering control. However, the operator can readily improve the sharpness of the turn if the outboard engine is accelerated at the time steering is accomplished. This will provide a greater power on the outboard side of the watercraft and make possible a sharper, more abrupt turn.

The types of controls previously provided, however, have necessitated separate controls for each engine and when these controls are mounted on the cowling of the watercraft, the operator must remove one of his hands from the steering mechanism so as to control the engine speed of the outboard engine. In addition, since it is desirable to provide the engine controls in close proximity to each other when they are remotely positioned, then the operator must be careful to make sure that he accelerates the proper engine. This type of system has obvious disadvantages.

It is, therefore, a principle object of this invention to provide an improved arrangement for controlling a watercraft having a pair of jet propulsion units each driven separately.

It is a further object of this invention to provide an improved throttle and steering control for a jet propelled watercraft having pairs of driving units.

This is a still further object of this invention to provide an improved control system for a jet propelled watercraft.

SUMMARY OF THE INVENTION

This invention is adapted to be embodied in a jet propelled watercraft that is comprises of hull with first and second jet propulsion units mounted in the hull in side by side fashion for powering the watercraft. First and second engines drive the first and second jet propulsion units respectively. Steering means are provided for steering the watercraft. In accordance with the invention, means are carried by the steering means for increasing the speed of one of the engines upon operation of the steering means for executing a sharper turn.

DETAILED DESCRIPTION OF THE PREFERRED EMBODIMENTS OF THE INVENTION

Figure 1:
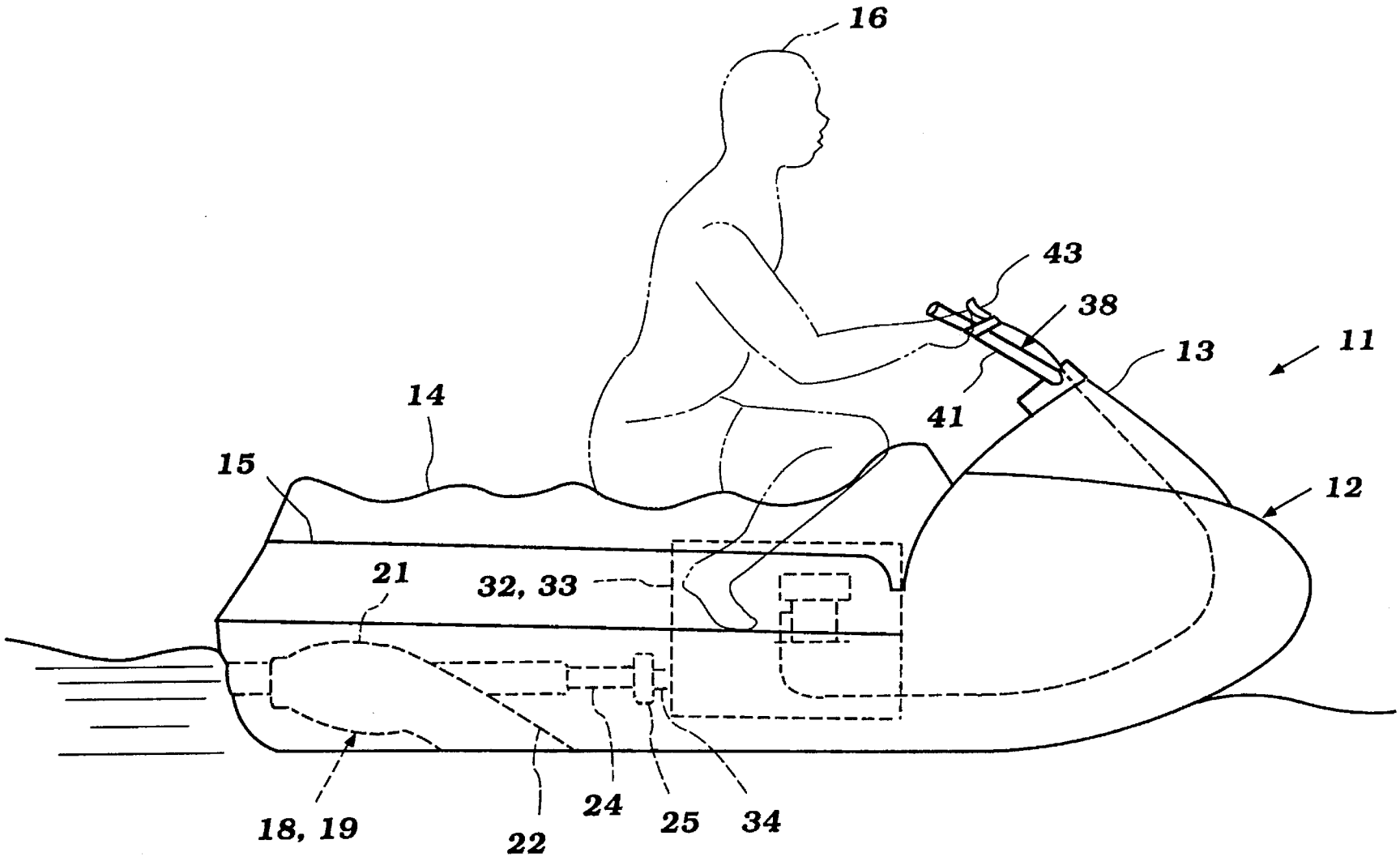
FIG. 1 is a side elevational view of a small watercraft constructed in accordance with a first embodiment of the invention.
Figure 2:
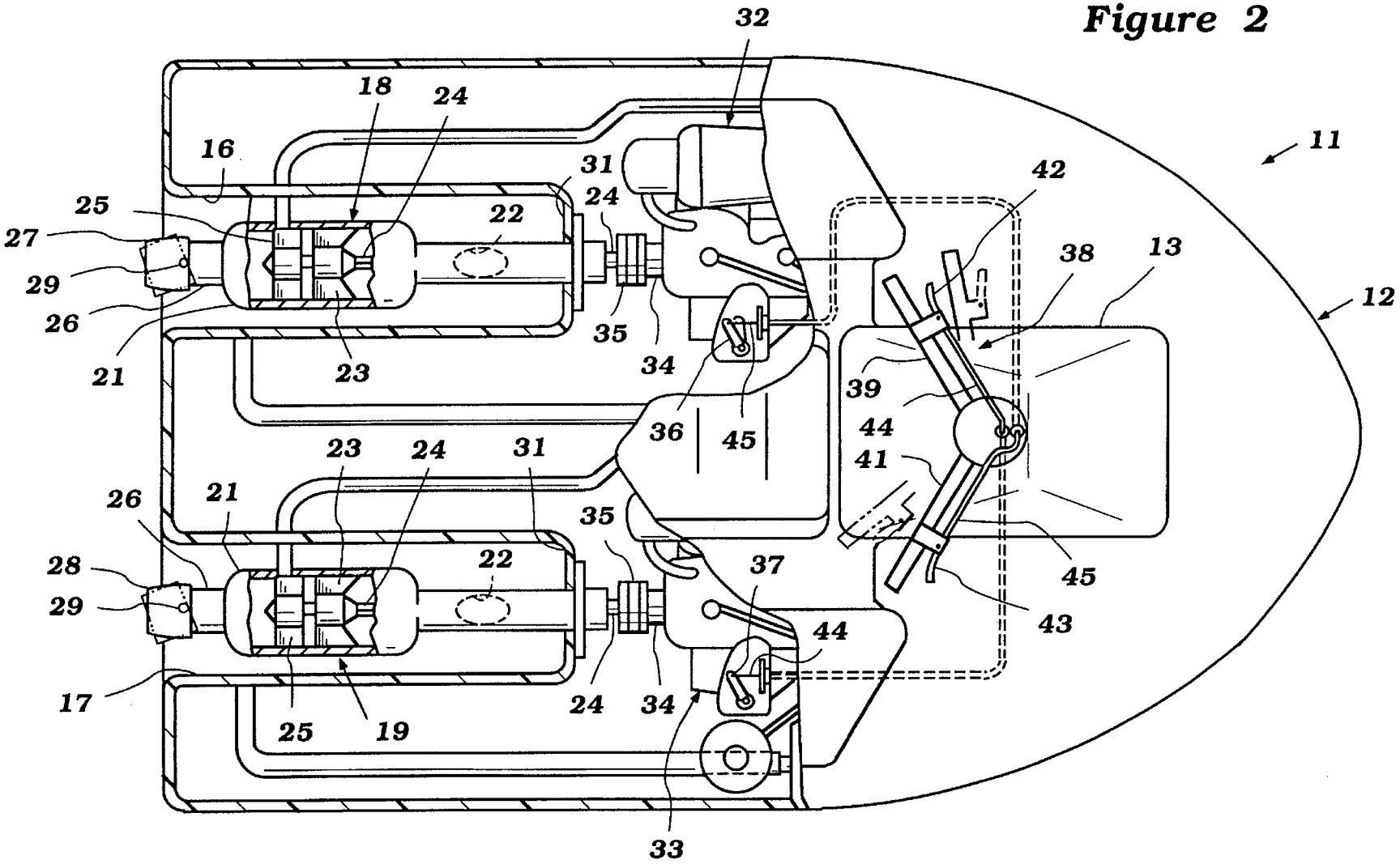
FIG. 2 is a slightly enlarged top plan view of the watercraft, with portions broken away to more clearly show the jet propulsion units, the drives therefore, and the controls.

Referring first primarily to FIGS. 1 and 2, a small watercraft constructed in accordance with an embodiment of the invention is identified generally by the reference numeral 11. It is to be understood that the type of watercraft 11 which is depicted and which will be described is typical of those types of watercraft which can be utilized in conjunction with the invention. However, the particular configuration of the watercraft 11 which will be described is to be considered only exemplary because the invention can be employed with a wide variety of watercraft. However, the invention has particular utility with watercraft having separately powered twin jet propulsion units.

The watercraft 11 is comprised of a hull, indicated generally by the reference numeral 12, and which may be formed from any suitable material such as a molded fiberglass reinforced resin or the like. As has already been noted, the configuration of the hull of the illustrated embodiment is to be considered typical of those which may practice the invention.

In the illustrated embodiment, the hull 12 is provided with a forward control mast area 13 that is positioned forwardly of an extending passengers area in which a seat 14 is provided. The seat 14 is designed so as to accommodate one or more riders seated in straddle tandem fashion, as is fairly typical with this type of watercraft. The hull 12 is provided with a pair of raised gunnels 15 on opposite sides of the seat 14 that define depressed foot ares in which a rider, shown in phantom and identified by the reference numeral 16, may place his feet.

The rear portion of the hull 12 on opposite sides of the seat 14 and beneath the foot areas 15 is provided with a pair of tunnels 16 and 17, shown in most detail in FIG. 2 and in which respective jet propulsion units, indicated generally by the reference numerals 18 and 19 are positioned. Each jet propulsion unit 18 and 19 has the same construction and is comprised of an outer housing 21 having a downwardly facing water inlet opening 22 that is flush with the bottom of the hull 12 and through which water is drawn. This water is drawn under the action of an impeller 23 that is contained within the outer housing 21 and which is affixed to a forwardly extending impeller shaft 24 that is journaled in a suitable manner and which is driven, in a manner to be described. This water then passes a plurality of straightening vanes 25 and is discharged rearwardly through a rearwardly facing discharge nozzle portion 26. Respective steering nozzles 27 and 28 are journaled on the discharged nozzle portions 26 of the jet propulsion units 18 and 19 respectively by vertically extending pivot pins 29. These steering nozzles 27 and 28 are controlled in a manner which will be described.

Each of the tunnel areas 16 and 17 is defined by a forward bulkhead 31 through which the respective impeller shaft 24 of its jet propulsion unit extends. An engine compartment is formed in the hull 12 forwardly of the bulkheads 31 and a pair of internal combustion engines 32 and 33 are provided in this engine compartment in side by side relationship. The engines 32 and 33 are, in the illustrated embodiment of the two cylinder in line crankcase compression type, but as will become readily apparent to those skilled in the art, the engines 32 and 33 may be of any known type. The engines 32 and 33 have their respective output shafts 34 coupled to the impeller shafts 24 of the jet propulsion units 18 and 19, respectively, by flexible couplings 35. Although the construction of the engines 32 and 33 may be of any known type, each engine is provided with a respective speed control 36 and 37 which in the illustrated embodiment are throttle levers connected to the throttle valves of their carburetors.

As has been noted, the control mast 13 positioned forwardly of the riders area provides for the control of the watercraft 11. This control includes a handlebar assembly, indicated generally by the reference numeral 38 which has a pair of handle portions 39 and 41 carried by a steering shaft (not shown) that is journaled in the mast area 13 in an appropriate manner. This steering shaft is coupled by means of bowden wire cables (not shown) to the steering nozzles 27 and 28 so that upon pivotal movement of the handlebar assembly 38, the steering nozzles 27 and 28 will be pivoted in unison and in the same direction.

Figure 3:
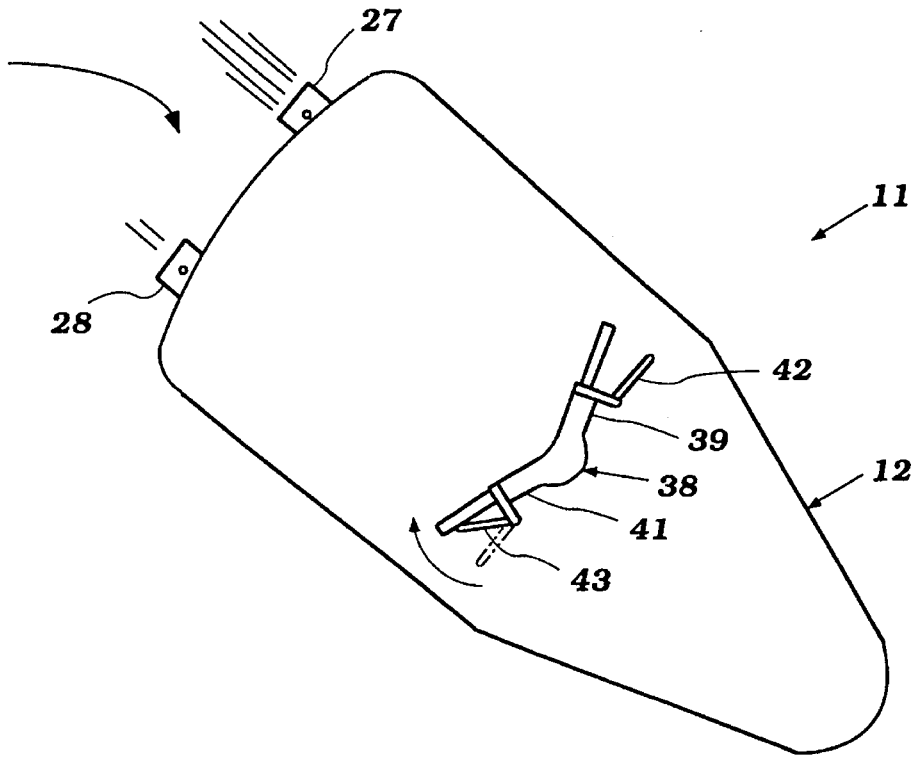
FIG. 3 is a top plan view showing the watercraft when executing a sharp right hand turn.
Figure 4:
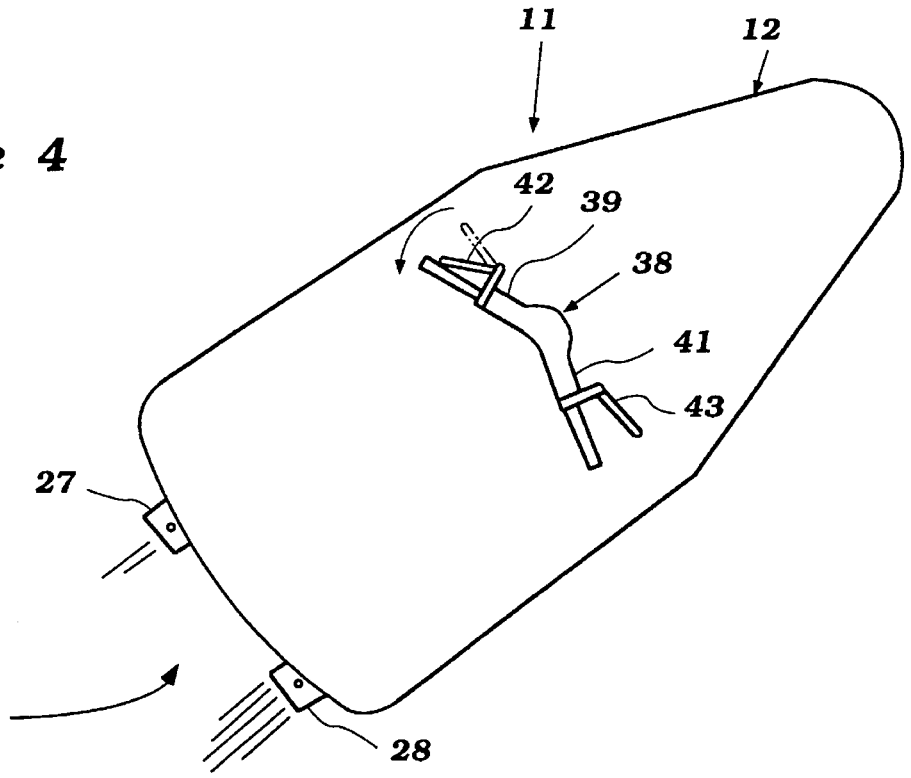
FIG. 4 is a top plan view, in part similar to FIG. 3, and shows the watercraft when executing a sharp left hand turn.

A pair of throttle control levers 42 and 43 are supported on the handlebar portions 39 and 41, respectively. The throttle control lever 42 on the left hand handlebar 39 is connected by means of a bowden wire cable 44 to the throttle control 37 of the right hand engine 33. In a similar manner, the throttle control lever 43 is connected by means of a bowden wire actuator 45 to the throttle control 36 of the left hand engine 32. The reason for this cross over control will become apparent by reference to FIGS. 3 and 4 which show the execution of right and left hand turns, respectively.

When turning right, the operator will rotate the handlebar or steering assembly 38 in a clockwise direction when viewed from above. If he wishes to make a sharper or crisper turn he will want to accelerate the left hand engine 32 and to do this he grips and closes the throttle control 43 on the right hand handlebar 41 in the same direction he is turning.

In a like manner, if the operator is making a left hand turn the handlebar (FIG. 4) the handlebar assembly 38 is rotated in a counter clockwise direction and if a crisper turn is required the operator closes the throttle 41 on the left hand side as to accelerate the right hand side engine 32 and effect a crisper turn. Hence, by crossing over the throttle controls 42 and 43 to the opposite sides of the handlebar assembly the operator can easily realize that to turn right more quickly he accelerates on the right hand throttle control and to turn left more quickly he accelerates on the left hand throttle control.

It should be readily apparent from the foregoing description that the described construction permits not only easy throttle control simultaneously with steering control, but also permits the operator to know which throttle to accelerate in order to accommodate a quicker or crisper turn, and the operator need not take his hands off of the steering control. Of course, the foregoing description is that of a preferred embodiment of the invention, and various changes and modifications may be made without departing from the spirit and scope of the invention, as defined by the appended claims.

What is claimed is:

1. A jet propelled watercraft comprised of a hull, first and second jet propulsion units mounted by said hull for powering said watercraft in side by side fashion, first and second engines for driving said first and second jet propulsion units, respectively, steering means for steering said watercraft, and means carried by said steering means for changing the condition of one of said propulsion units upon the operation of said steering means for executing a sharper turn.

2. A jet propelled watercraft as set forth in claim 1 wherein the means carried by the steering means comprises means for increasing the speed of one of said engines.

3. A jet propelled watercraft as set forth in claim 2 wherein said means for increasing the speed of one of said engines includes an operator controlled throttle control.

4. A jet propelled watercraft as set forth in claim 1 wherein the means carried for the steering means by increasing the speed of the engines comprises means carried by the steering means for controlling the speed of each of the engines.

5. A jet propelled watercraft as set forth in claim 4 wherein the means for increasing the speed of each of the engines is an operator controlled throttle control.

6. A jet propelled watercraft as set forth in claim 5 wherein the throttle control for the left side engine is carried at the right side of the steering means and the throttle control for the left side engine is carried by the right hand side of the steering means.

7. A jet propelled watercraft as set forth in claim 6 wherein the steering means comprises a handlebar assembly and the throttle controls are carried at the respective ends of the handlebars.

8. A jet propelled watercraft as set forth in claim 1 wherein the means carried by the steering means comprises means for changing the condition of water dishcarge from said jet propulsion units.

9. A jet propelled watercraft comprised of a hull, first and second jet propulsion units mounted by said hull for powering said watercraft, said jet propulsion units being disposed in side by side fashion, first and second engines for driving said first and second jet propulsion units, respectively, each of said engines having a respective throttle control, handlebar means for steering of said watercraft, a first throttle control carried by the left hand side of said handlebar means for controlling the throttle control of the right hand side engine, and second throttle control means carried by the right hand side of said handlebar means for controlling the throttle control of the left hand side and engine.

10. A jet propelled watercraft as set forth in claim 9 wherein the handlebar means operates a pair of steering nozzles each pivotally supported by a respective one of the jet propulsion units.

* * * * *